US009370281B2

(12) United States Patent
Harewood

(10) Patent No.: US 9,370,281 B2
(45) Date of Patent: Jun. 21, 2016

(54) SCRUBBING DEVICE

(71) Applicant: Addison I. Harewood, Salinas, CA (US)

(72) Inventor: Addison I. Harewood, Salinas, CA (US)

(73) Assignee: Addison I. Harewood, Salinas, CA (US)

( * ) Notice: Subject to any disclaimer, the term of this patent is extended or adjusted under 35 U.S.C. 154(b) by 39 days.

(21) Appl. No.: 14/335,424

(22) Filed: Jul. 18, 2014

(65) Prior Publication Data

US 2016/0015224 A1 Jan. 21, 2016

(51) Int. Cl.

| | |
|---|---|
| ***A47K 7/02*** | (2006.01) |
| ***A46B 13/04*** | (2006.01) |
| ***A47K 7/03*** | (2006.01) |
| ***A46B 11/00*** | (2006.01) |
| ***A47K 7/04*** | (2006.01) |
| ***A46B 15/00*** | (2006.01) |

(52) U.S. Cl.

CPC ..... *A47K 7/028* (2013.01); *A46B 11/0006* (2013.01); *A46B 15/004* (2013.01); *A46B 15/0016* (2013.01); *A46B 15/0042* (2013.01); *A46B 15/0051* (2013.01); *A46B 15/0055* (2013.01); *A47K 7/03* (2013.01); *A47K 7/04* (2013.01)

(58) Field of Classification Search

CPC ..... A47K 7/028; A47K 7/03; A47K 7/04; A46B 11/0006; A46B 15/0016; A46B 15/004; A46B 15/0042; A46B 15/0051; A46B 15/0055

See application file for complete search history.

(56) References Cited

U.S. PATENT DOCUMENTS

| | | | | |
|---|---|---|---|---|
| 5,099,578 | A | 3/1992 | Jan | |
| 5,345,640 | A | 9/1994 | Goss | |
| 5,385,532 | A * | 1/1995 | Shyu | A46B 13/06 15/29 |
| D358,258 | S | 5/1995 | Gingras | |
| 5,647,841 | A * | 7/1997 | Groenewold | A46B 13/04 15/29 |
| 5,875,511 | A | 3/1999 | Nejdi | |
| 6,754,929 | B2 | 6/2004 | Fichter | |
| 6,996,861 | B1 | 2/2006 | Clark, Jr. | |
| 7,451,513 | B2 | 11/2008 | Torres | |
| 7,503,715 | B2 | 3/2009 | Khubani | |
| 7,976,235 | B2 * | 7/2011 | Hoadley | A46B 5/0075 401/138 |
| 8,360,668 | B1 * | 1/2013 | Hinnant | A46B 5/0075 401/188 R |
| 9,055,845 | B1 * | 6/2015 | Hooper | A47K 7/04 |
| 2009/0241257 | A1 | 10/2009 | Malta | |
| 2011/0094528 | A1 * | 4/2011 | Leung | A46B 9/023 132/120 |
| 2011/0145986 | A1 | 6/2011 | Rowles | |
| 2013/0039039 | A1 * | 2/2013 | Patel | A46B 7/04 362/109 |

FOREIGN PATENT DOCUMENTS

| | | | |
|---|---|---|---|
| DE | 004029770 | A1 * | 3/1992 |

* cited by examiner

*Primary Examiner* — Shay Karls

(57) ABSTRACT

A scrubbing device simplifies the task of cleaning a person's body. The device includes a housing unit. The housing unit includes a main housing having a top wall, a bottom wall and a perimeter wall coupled to and extending between the top wall and the bottom wall. The top wall has an opening positioned therein defining a compartment extending downwardly into the top wall. The compartment stores soap therein. A handle is provided having a first end and a second end. The first end of the handle is coupled to the housing unit. A brush is coupled to and extends downwardly from the bottom wall of the main housing. A plurality of holes is positioned in the bottom wall between the compartment and the brush wherein the holes are configured to dispense the soap from the compartment outwardly to the brush.

18 Claims, 4 Drawing Sheets

SCRUBBING DEVICE

BACKGROUND OF THE DISCLOSURE

Field of the Disclosure

The disclosure relates to cleaning devices and more particularly pertains to a new cleaning device for simplifying the task of cleaning a person's body.

SUMMARY OF THE DISCLOSURE

An embodiment of the disclosure meets the needs presented above by generally comprising a housing unit. The housing unit includes a main housing having a top wall, a bottom wall and a perimeter wall coupled to and extending between the top wall and the bottom wall. The top wall has an opening positioned therein defining a compartment extending downwardly into the top wall. The compartment stores soap therein. A handle is provided having a first end and a second end. The first end of the handle is coupled to the housing unit. A brush is coupled to and extends downwardly from the bottom wall of the main housing. A plurality of holes is positioned in the bottom wall between the compartment and the brush wherein the holes are configured to dispense the soap from the compartment outwardly to the brush.

There has thus been outlined, rather broadly, the more important features of the disclosure in order that the detailed description thereof that follows may be better understood, and in order that the present contribution to the art may be better appreciated.

There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
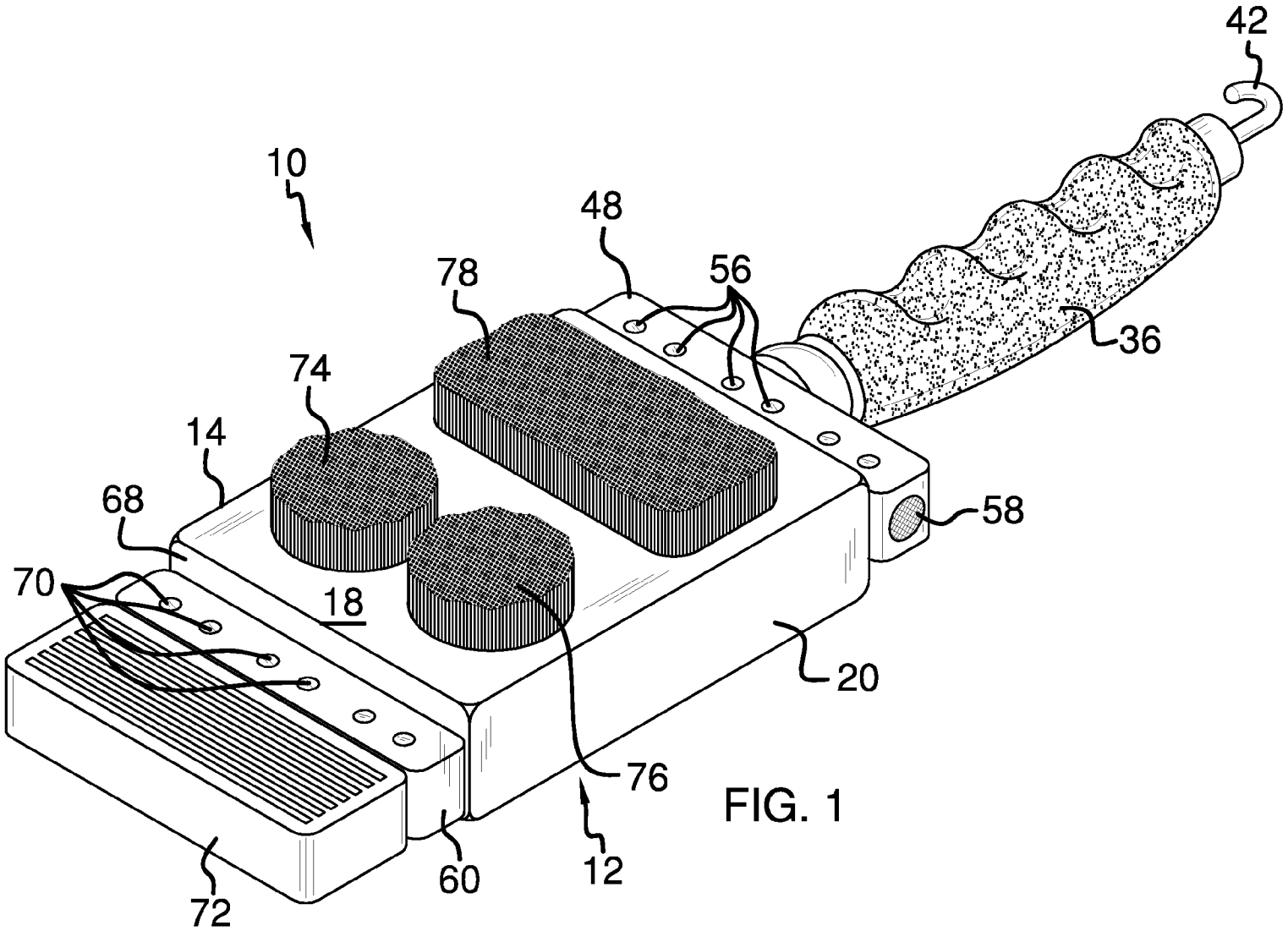
FIG. 1 is a bottom front side perspective view of a scrubbing device according to an embodiment of the disclosure.
Figure 2:
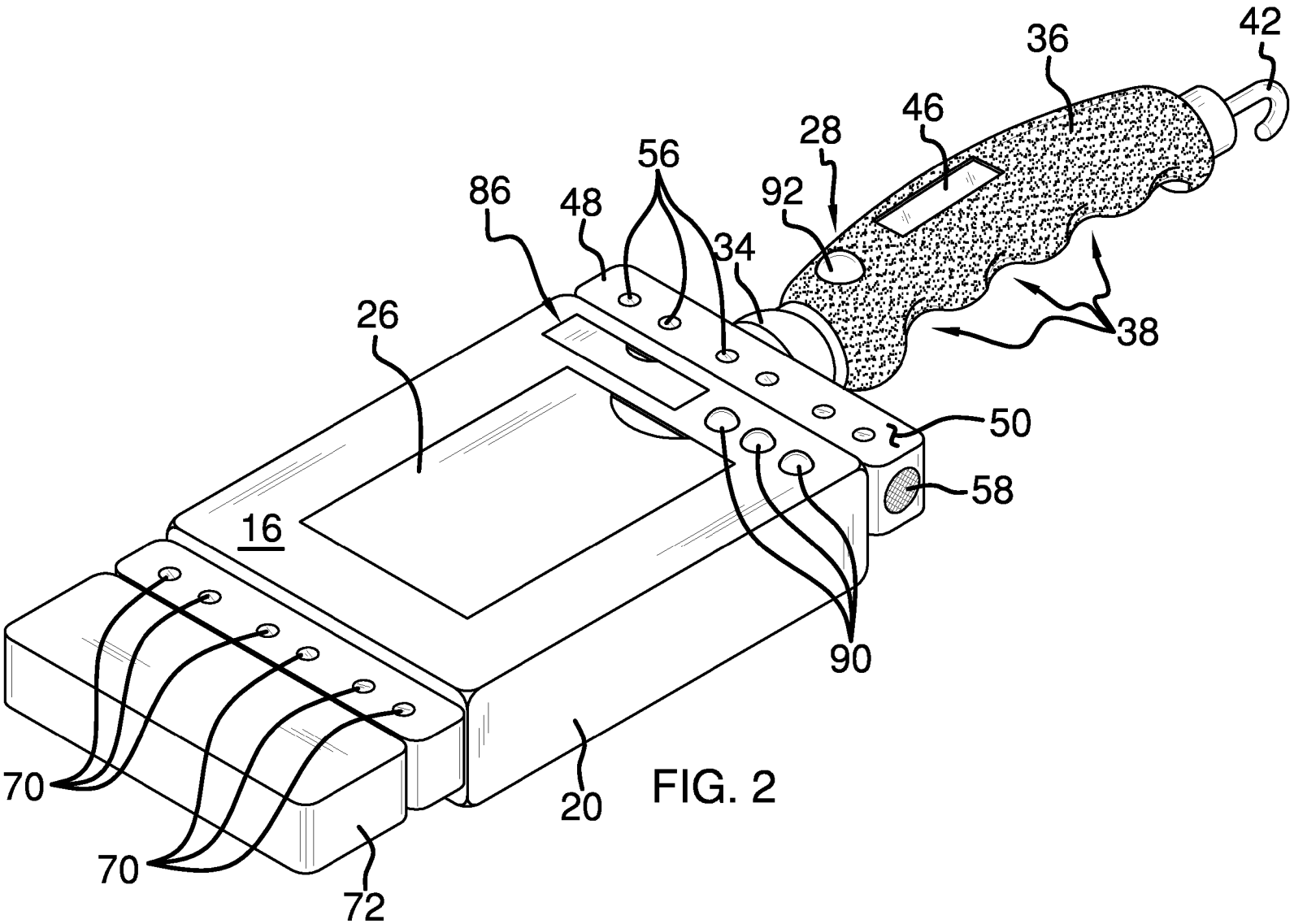
FIG. 2 is a top front side perspective view of an embodiment of the disclosure.
Figure 3:
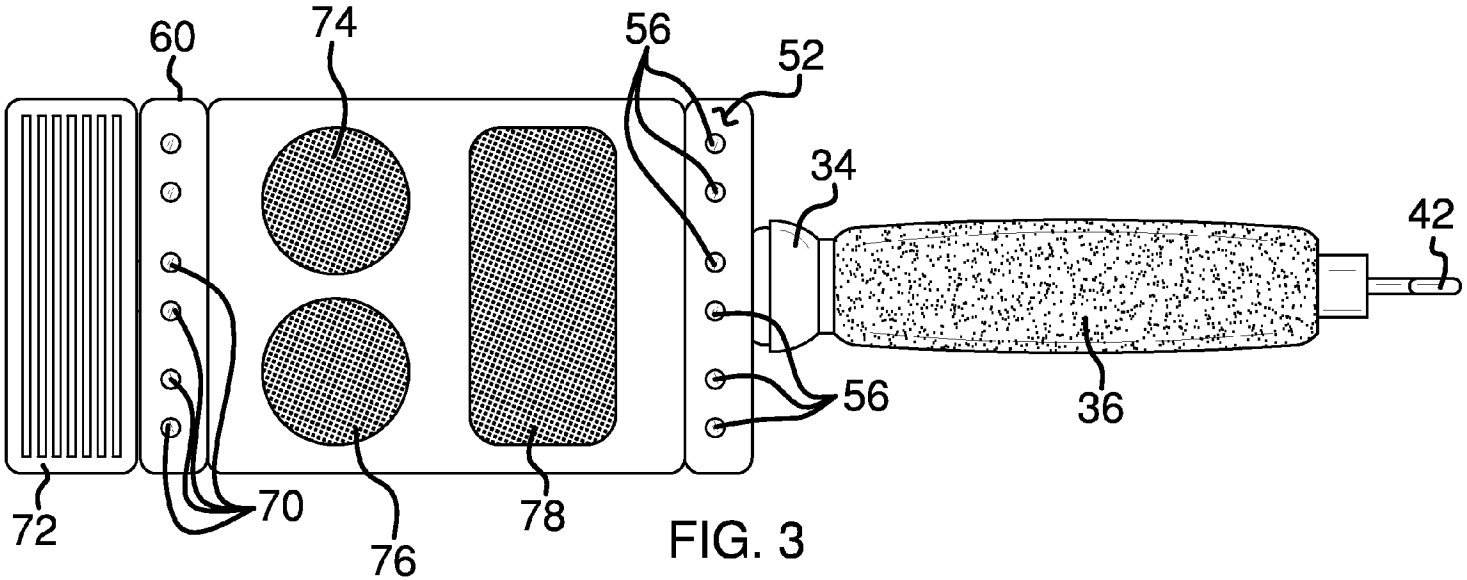
FIG. 3 is a bottom view of an embodiment of the disclosure.
Figure 4:
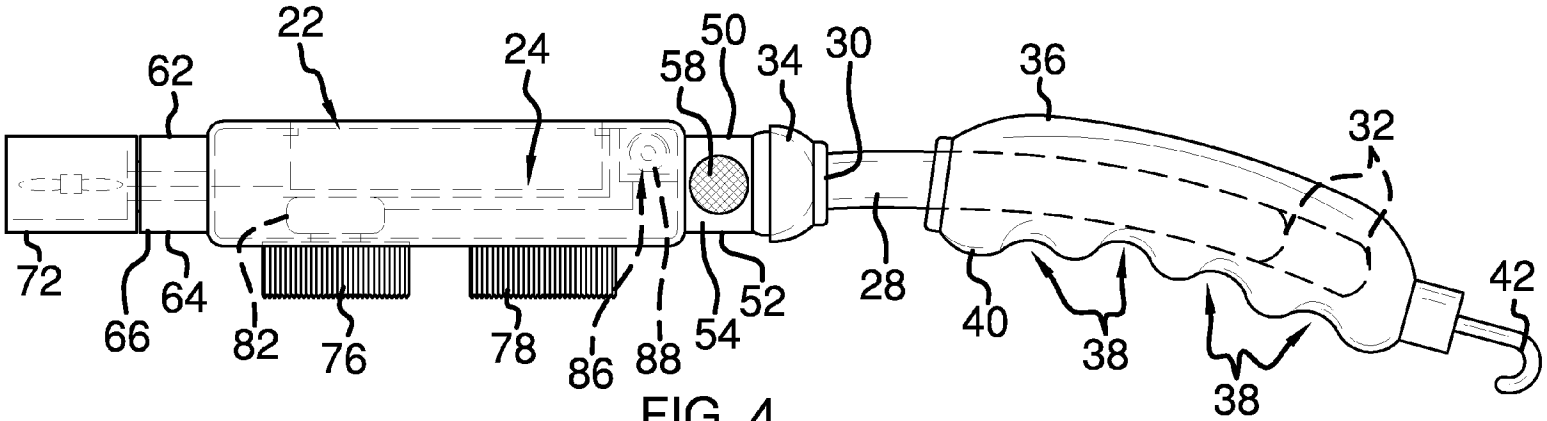
FIG. 4 is a side view of an embodiment of the disclosure.
Figure 5:
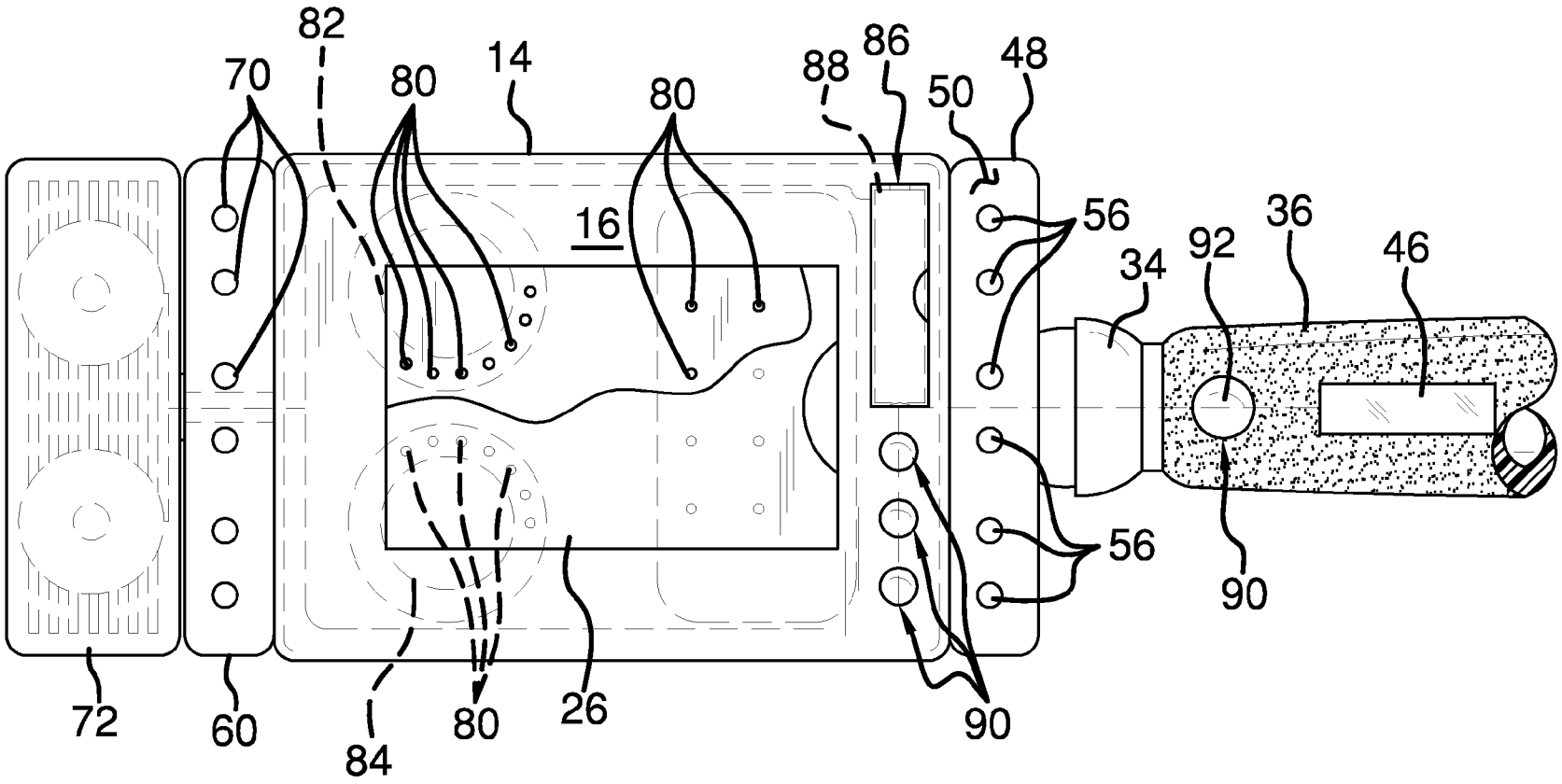
FIG. 5 is a top view of an embodiment of the disclosure.

With reference now to the drawings, and in particular to FIGS. 1 through 5 thereof, a new cleaning device embodying the principles and concepts of an embodiment of the disclosure and generally designated by the reference numeral 10 will be described.

As best illustrated in FIGS. 1 through 5, the scrubbing device 10 generally comprises a housing unit 12. The housing unit 12 includes a main housing 14 having a top wall 16, a bottom wall 18 and a perimeter wall 20 coupled to and extending between the top wall 16 and the bottom wall 18. The top wall 16 has an opening 22 positioned therein defining a compartment 24 extending downwardly into the top wall 16. The compartment 24 is configured for storing soap therein. A cover 26 is positionable to close the opening 22.

A handle 28 is provided having a first end 30 and a second end 32. The first end 30 of the handle 28 is coupled to the housing unit 12. The handle 28 may be telescopic in a generally conventional manner. The handle 28 may curve between the first end 30 and the second end 32 of the handle 28. A pivot joint 34 pivotally couples the first end 30 of the handle 28 to the housing unit 12. A grip 36 is attached to the handle 28 and may be comprised of a gel material, an elastomeric material or the like. The grip 36 may have a plurality of indentations 38 extending into a bottom surface 40 thereof to facilitate gripping of the handle 28. A hook 42 is attached to a rear end 44 of the grip 36 extending away from the second end 32 of the handle 28 to facilitate hanging of the device 10 from a wall surface. A clock 46 is coupled to the handle 28 and is electronically configured to indicate the time of day.

The housing unit 12 may further include a rear entertainment housing 48 having an upper wall 50, a lower wall 52 and a peripheral wall 54 coupled to and extending between the upper wall 50 and the lower wall 52. The peripheral wall 54 is attached to the perimeter wall 20 of the main housing 14 and the first end 30 of the handle 28. A plurality of lights 56 and at least one speaker 58 are coupled to the rear entertainment housing 48. The lights 56 may be coupled to either or both of the upper wall 50 and the lower wall 52 of the rear entertainment housing 48.

The housing unit 12 may also include a front entertainment housing 60 having an uppermost wall 62, a lowermost wall 64 and an outer wall 66 coupled to and extending between the uppermost wall 62 and the lowermost wall 64. The outer wall 66 is attached to a front end 68 of the perimeter wall 20. A plurality of lights 70 is coupled to the front entertainment housing 60 and may be coupled to either or both of the uppermost wall 62 and the lowermost wall 64. A blower fan unit 72 is coupled to the front entertainment housing 60 and may be pivotally coupled thereto.

A plurality of brushes 74, 76, 78 is coupled to and extends downwardly from the bottom wall 18 of the main housing 14. The bottom wall 18 has a plurality of holes 80 extending therein positioned between the compartment 24 and the brushes 74, 76, 78 wherein the holes 80 are configured to dispense the soap from the compartment 24 outwardly to the brushes 74, 76, 78. A plurality of brush motors 82, 84 is positioned within an interior of the main housing 14. Each of the brush motors 82, 84 is operationally coupled to an associated one of the brushes 74, 76, 78 wherein actuation of the brush motors 82, 84 to an on position causes the brushes 74, 76, 78 to rotate. At least one of the brushes 74, 76, 78 is controlled manually and not electrically. A power source 86 is coupled to the main housing 14 and is electrically coupled to each of the blower fan unit 72, the brush motors 82, 84, each of the lights 56, 70, the clock 46 and each speaker 58. The power source 86 may comprise at least one rechargeable battery 88.

The device 10 may further include a plurality of controls 90 each electrically coupled to the power source 86. The controls 90 may include, for example, an on/off control 92, a volume control for the speaker 58, a speed control for the brush motors 82, 84, a fan actuator for activating the blower fan unit 72, a fan movement control for controlling whether the blower fan unit 72 pivots or remains stationary relative to the front entertainment housing 60.

In use, the compartment 24 is filled with soap. The on/off control 92 is actuated and the brushes 74, 76, 78 are rubbed onto a person's body to clean and massage the person's body. The blower fan unit 72 can be activated for emitting warm air. The controls 90 are manipulated to control the speed of the brush motors 82, 84, the movement of the blower fan unit 72 and the volume of the speaker 58.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A scrubbing device comprising:

a housing unit including a main housing having a top wall, a bottom wall and a perimeter wall coupled to and extending between said top wall and said bottom wall, said top wall having an opening positioned therein defining a compartment extending downwardly into said top wall, said compartment being configured for storing soap therein;

a handle having a first end and a second end, said first end of said handle being coupled to said housing unit;

a brush coupled to and extending downwardly from said bottom wall of said main housing;

said bottom wall having a plurality of holes extending therein positioned between said compartment and said brush wherein said holes are configured to dispense the soap from said compartment outwardly to said brush;

a front entertainment housing having an uppermost wall, a lowermost wall and an outer wall coupled to and extending between said uppermost wall and said lowermost wall, said outer wall being attached to a front end of said perimeter wall;

a plurality of lights coupled to said front entertainment housing; and a blower fan unit coupled to said front entertainment housing.

2. The device of claim 1, further comprising a cover positionable to close said opening.

3. The device of claim 1, further comprising said handle being telescopic.

4. The device of claim 1, further comprising a grip being attached to said handle.

5. The device of claim 4, further comprising said grip being comprised of a gel material.

6. The device of claim 4, further comprising a hook being attached to a rear end of said grip extending away from said second end of said handle.

7. The device of claim 4, further comprising said grip having a plurality of indentations extending into a bottom surface thereof to facilitate gripping of said handle.

8. The device of claim 1, further comprising said handle curving between said first end and said second end.

9. The device of claim 1, further comprising a pivot joint pivotally coupling said first end of said handle to said housing unit.

10. The device of claim 1, further comprising a clock coupled to said handle, said clock being electronically configured to indicate the time of day.

11. The device of claim 1, further comprising:

said housing unit including a rear entertainment housing having an upper wall, a lower wall and a peripheral wall coupled to and extending between said upper wall and said lower wall, said peripheral wall being attached to said perimeter wall of said main housing and said first end of said handle; and at least one speaker coupled to said rear entertainment housing.

12. The device of claim 1, further comprising:

said housing unit including a rear entertainment housing having an upper wall, a lower wall and a peripheral wall coupled to and extending between said upper wall and said lower wall, said peripheral wall being attached to a rear end of said perimeter wall and to said first end of said handle; and a plurality of lights coupled to said rear entertainment housing.

13. The device of claim 12, further comprising said plurality of lights of said rear entertainment housing being coupled to said upper wall and said lower wall of said rear entertainment housing.

14. The device of claim 1, further comprising a brush motor positioned within an interior of said main housing, said brush motor being operationally coupled to said brush wherein actuation of said brush motor to an on position causes said brush to rotate.

15. The device of claim 14, further comprising said brush being one of a plurality of said brushes, each of said brushes being positioned adjacent to each other on said bottom wall of said main housing, said brush motor being one of a plurality of brush motors, each of said brush motors being operationally coupled to an associated one of said brushes wherein actuation of said brush motors to an on position causes said brushes to rotate.

16. The device of claim 1, further comprising said plurality of lights of said front entertainment housing being coupled to said uppermost wall and said lowermost wall of said front entertainment housing.

17. The device of claim 1, further comprising said blower fan unit being pivotally coupled to said front entertainment housing.

18. A scrubbing device comprising:

a housing unit including;

a main housing having a top wall, a bottom wall and a perimeter wall coupled to and extending between said top wall and said bottom wall, said top wall having an opening positioned therein defining a compartment extending downwardly into said top wall, said compartment being configured for storing soap therein;

a rear entertainment housing having an upper wall, a lower wall and a peripheral wall coupled to and extending between said upper wall and said lower wall, said peripheral wall being attached to said perimeter wall of said main housing, at least one speaker coupled to said rear entertainment housing, a plurality of lights coupled to said upper wall and said lower wall of said rear entertainment housing; and a front entertainment housing having an uppermost wall, a lowermost wall and an outer wall coupled to and extending between said uppermost wall and said lowermost wall, said outer wall being attached to a front end of said perimeter wall, a plurality of lights coupled to said uppermost wall and said lowermost wall of said front entertainment housing, a blower fan unit pivotally coupled to said front entertainment housing;

a cover positionable to close said opening;

a handle having a first end and a second end, said first end of said handle being coupled to said peripheral wall of said rear entertainment housing, said handle being telescopic, said handle curving between said first end and said second end;

a pivot joint pivotally coupling said first end of said handle to said housing unit;

a grip being attached to said handle, said grip being comprised of a gel material, said grip having a plurality of indentations extending into a bottom surface thereof to facilitate gripping of said handle;

a hook being attached to a rear end of said grip extending away from said second end of said handle;

a clock coupled to said handle, said clock being electronically configured to indicate the time of day;

a plurality of brushes coupled to and extending downwardly from said bottom wall of said main housing, each of said brushes being positioned adjacent to each other on said bottom wall of said main housing;

a plurality of brush motors positioned within an interior of said main housing, each of said brush motors being operationally coupled to an associated one of said brushes wherein actuation of said brush motors to an on position causes said brushes to rotate;

said bottom wall having a plurality of holes extending therein and positioned between said compartment and said brushes wherein said holes are configured to dispense the soap from said compartment outwardly to said brushes; and a power source coupled to said main housing, said power source being electrically coupled to each of said blower fan unit, said brush motors, said lights, each said speaker, and said clock, said power source comprising at least one rechargeable battery.

* * * * *